US007568298B2

(12) United States Patent
Kerns

(10) Patent No.: US 7,568,298 B2
(45) Date of Patent: Aug. 4, 2009

(54) ENGINEERED FABRIC WITH TIGHTENING CHANNELS

(75) Inventor: Mark Kerns, Golden, CO (US)

(73) Assignee: DashAmerica, Inc., Louisville, CO (US)

( * ) Notice: Subject to any disclaimer, the term of this patent is extended or adjusted under 35 U.S.C. 154(b) by 0 days.

(21) Appl. No.: 10/877,091

(22) Filed: Jun. 24, 2004

(65) Prior Publication Data

US 2005/0284000 A1 Dec. 29, 2005

(51) Int. Cl.
*A43C 11/12* (2006.01)
*A41D 1/00* (2006.01)

(52) U.S. Cl. ..... 36/50.1; 2/96

(58) Field of Classification Search ..... 36/50.1, 36/51, 91, 170, 58.5, 58.6
See application file for complete search history.

(56) References Cited

U.S. PATENT DOCUMENTS

| | | | | |
|---|---|---|---|---|
| 4,192,086 | A * | 3/1980 | Sichak | 36/44 |
| 4,785,558 | A * | 11/1988 | Shiomura | 36/114 |
| 4,813,158 | A | 3/1989 | Brown | |
| 5,016,327 | A | 5/1991 | Klausner | |
| 5,117,567 | A | 6/1992 | Berger | |
| 5,177,882 | A | 1/1993 | Berger | |
| 5,371,926 | A | 12/1994 | Van Noy et al. | |
| 5,371,957 | A * | 12/1994 | Gaudio | 36/50.1 |
| 5,566,475 | A | 10/1996 | Donnadieu | |
| 5,704,138 | A | 1/1998 | Donnadieu | |
| 5,755,044 | A | 5/1998 | Veylupek | |
| 5,934,599 | A | 8/1999 | Hammerslag | |
| 6,029,376 | A | 2/2000 | Cass | |
| 6,032,387 | A * | 3/2000 | Johnson | 36/50.1 |
| 6,052,921 | A * | 4/2000 | Oreck | 36/50.1 |
| 6,083,857 | A * | 7/2000 | Bottger et al. | 442/370 |
| 6,286,233 | B1 * | 9/2001 | Gaither | 36/50.1 |
| 6,289,558 | B1 | 9/2001 | Hammerslag | |
| 6,477,793 | B1 | 11/2002 | Pruitt et al. | |
| 6,482,492 | B1 | 11/2002 | Hung | |
| 6,505,424 | B2 | 1/2003 | Oorei et al. | |
| 6,557,274 | B2 | 5/2003 | Litchfield et al. | |
| 6,922,917 | B2 | 8/2005 | Kerns et al. | |
| 7,086,181 | B2 | 8/2006 | Farys | |
| 7,200,957 | B2 | 4/2007 | Hubbard et al. | |
| 2003/0066207 | A1 * | 4/2003 | Gaither | 36/50.1 |
| 2004/0181972 | A1 * | 9/2004 | Csorba | 36/50.1 |
| 2005/0178026 | A1 | 8/2005 | Friton | |
| 2005/0198866 | A1 | 9/2005 | King et al. | |

FOREIGN PATENT DOCUMENTS

| | | |
|---|---|---|
| EP | 0090580 | 10/2003 |
| EP | 1163860 | 7/2005 |
| GB | 2333688 | 8/1999 |

(Continued)

OTHER PUBLICATIONS

International Search Report date Feb. 8, 2007, PCT/US2005/018445, 2 pages.

(Continued)

*Primary Examiner*—Ted Kavanaugh
(74) *Attorney, Agent, or Firm*—Sheridan Ross P.C.

(57) ABSTRACT

The present invention provides a 3-D fabric with a plurality of channels. Loops in the channels distribute force over the fabric.

18 Claims, 2 Drawing Sheets

FOREIGN PATENT DOCUMENTS

| | | |
|---|---|---|
| GB | 2342275 | 4/2000 |
| WO | WO 98/043506 | 10/1998 |

OTHER PUBLICATIONS

Nullity Complaint in the Federal Patent Court, Munich, dated Apr. 22, 2008, (filed on May 16, 2008) against De-P 601 12 187.2 (EP 1 163 860 B1), *Pearl Izumi GmbH and DashAmerica, Inc.* v. *Salomon S.A.*, 206 pages.

Staples, Jeff; Webpage for Blog to Darrin Hudson; http://www.stapledesign.com/jeffstaple/2006/04/nike-air-max-95.html; published at least as early as Apr. 2006 and referring to a Nike Air Max '95 shoe manufactured in 1997; 5 pages.

Nike Product Brochure, 1 page, published at least as early as 1995.

Photograph of Nike Air Max 95, shoe sold in the U.S. at least as early as Jan. 1, 2000.

* cited by examiner

ENGINEERED FABRIC WITH TIGHTENING CHANNELS

FIELD OF THE INVENTION

The present invention relates to an engineered fabric and, more particularly, an engineered fabric having channels to facilitate tightening a shoe upper about the foot of a wearer.

BACKGROUND OF THE INVENTION

There exist many mechanisms for tightening shoes, boots, skates, and other footwear. Conventional mechanisms for tightening footwear range from simple manual lace tightening to more complex buckles or clamps and the like. Manual lace tightening has many drawbacks including, for example, difficulty in adjusting the lace tightness and uneven distribution of pressure from the tightening. Buckle and clamp style systems, while quicker than manual lace tightening, cause pressure points where the buckles or clamps exist. These pressure points cause localized hot spots and irritation, which can lead to blisters and the like.

VELCRO® straps can be used in place of buckles and/or laces, but they suffer many of the drawbacks of buckles in they produce localized pressure points and uneven tightness distribution. Further, the straps are prearranged, similar to buckles, inhibiting the shoe from free forming to a user's foot shape. The result is localized pressure points and hotspots that can irritate the foot.

An existing automatic lace tightening system is described by U.S. Pat. No. 6,289,558, issued Sep. 18, 2001, and U.S. Pat. No. 5,934,599, issued Aug. 10, 1999, both titled FOOTWEAR LACING SYSTEM, both issued to Hammerslag. The Hammerslag Patents describe a circular tightening apparatus that is rotated to tighten the laces and locked in place with a ratchet and pawl lock. The laces are loosened by releasing the lock by lifting the pawl and pulling on the laces to loosen them, or using reverse rotation of the ratchet. As can be seen, the Hammerslag Patents disclose a conventional shoe having an upper with an open throat. Opposing sides of the upper are tightened using the laces and tightening system of the Hammerslag Patents.

All of the above systems, are ways to tighten the throat or canopy of the shoe. While this is helpful, the shoes uppers still bind or develop local hotspots around the majority of the foot. In order to inhibit the formation of local hotspots or other irritating pressure points, multi-layer upper constructions are being developed. Referring to FIGS. 1 and 2, an upper 100 is shown. FIG. 1 shows an elevation view of upper 100 on a shoe and FIG. 2 shows a cross section of upper 100 exploded. Referring first to FIG. 1, upper 100 includes a series of loops or hooks 2, 4, 6, 8, and 10 on each side of upper 100. Loops 2, 4, 6, 8, and 10 have a top section 12 through which laces may be threaded. Loops 2, 4, 6, 8, and 10 also have a bottom section 14 typically attached at the upper sole junction 16. Thus the bottom is typically stitched, adhered, or fused in upper sole junction 16. As can be seen from FIG. 1, by threading the laces through top sections 12, when the laces are tightened about a shoe throat 18 (or gap), loops 2, 4, 6, 8, and 10 distribute the tightening substantially equally about the foot to prevent binding, hotspots, and other irritation.

Referring to FIG. 2, an exploded cross section of upper 100 is shown. Upper 100 comprises (from inside the shoe out) a backing layer 22, a mesh or breathable fabric layer 24, a bonding layer 26, a loop layer 28, and a topside layer 30. Optionally, another bonding layer 26 may exist between backing layer 22 and fabric layer 24 and between loop layer 28 and topside layer 29. Loops 6 and 8 are shown in loop layer 28. While FIG. 2 is not drawn to scale, one of ordinary skill in the art appreciates that constructing upper 100 this way reduces breathability, increases weight, reduces moisture management, and increases production time and cost, but is designed to increase comfort by distributing the effects of lace tightening around more of the foot.

Thus, it would be desirous to develop an improved fabric that would facilitate shoe tightening and inhibit the formation of hotspots or other irritants, but also increase breathability, increase moisture management, decrease weight, and decrease production costs and time.

SUMMARY OF THE INVENTION

To attain the advantages and in accordance with the present invention, a shoe upper with tightening channels is provided. The shoe upper comprises a three dimensional fabric having a sole attachment side and a throat side. The fabric has a top facing side, a body, and a back facing side. The body contains a plurality of channels. At least one loop in the plurality of channels distributes force when the shoe is tightened.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
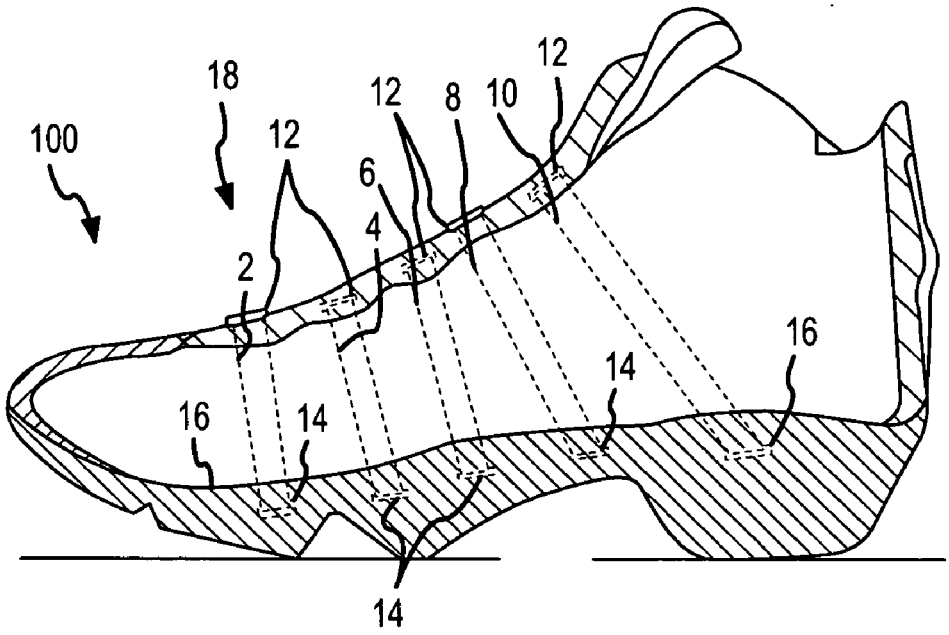
(PRIOR ART) FIG.1
FIG. 1 is an elevation view of a prior art upper.

The present invention will be explained with reference to FIGS. 1-3. While the present invention will be explained in connection with shoes, and specifically running or athletic shoes, one or ordinary skill in the art would recognize that other textiles requiring lacing could equally benefit from the present invention and the references to shoes should be considered exemplary and non-limiting. Further, references to FIG. 1 are generic in nature and should not be considered limiting.

Figure 3:
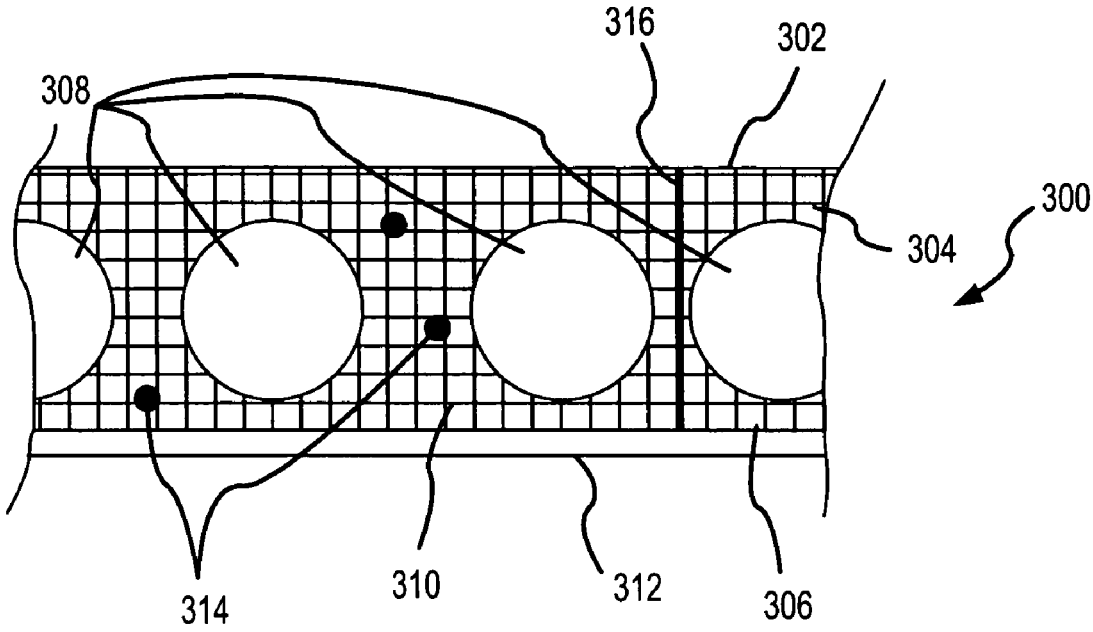
FIG. 3 is a cross section view of an upper consistent with an embodiment of the present invention.

Referring first to FIG. 3, a fabric 300 consistent with the present invention is shown. Fabric 300 is a 3 dimensional mesh fabric. While fabric 300 uses a mesh knit, one of ordinary skill in the art would understand other types of 3 dimensional fabrics are possible using woven and non-woven techniques. Fabric 300 includes a top facing side 302, a body 304, and a back facing side 306. Engineered into body 304 are voids 308. Voids 308 form channels for loops 2, 4, 6, 8, and 10 (FIG. 1).

While fabric 300 could use a consistent knit 310 over the entire fabric, it would be possible to vary the knit over fabric 300 such that top facing side 302 had a different knit than body 304. Thus, top facing side 302 could be a denser or tightly woven layer while body 304 is less dense and more breathable. Similarly, back facing side 306 could have a different knit than body 304. Notice, top facing side 302 and back facing side 306 could have the same or different knits as well.

Figure 2:
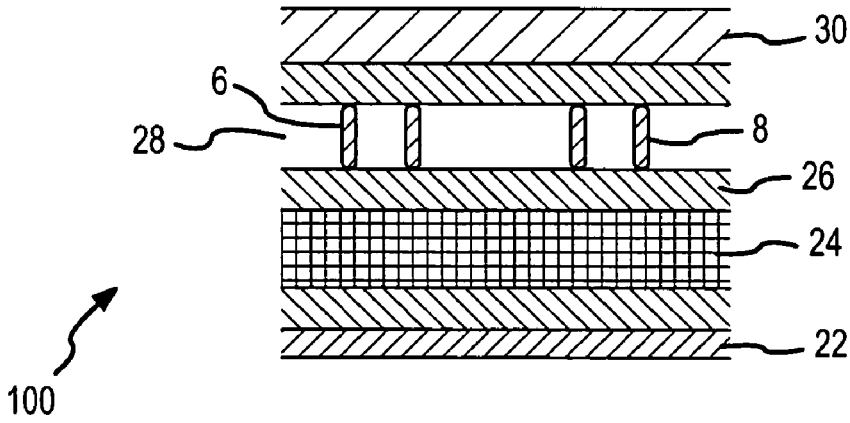
FIG. 2 is a cross sectional view of the upper associated with FIG. 1.

Using the present invention, upper 100 could be constructed out of a single layer of fabric 300 instead of the composite fabric shown in FIG. 2. Although a single layer is possible with fabric 300, additional layers could optionally be added. For example, a layer 312 could be added to the back facing side 306 (which is the side closest to the foot). Layer 312 could be constructed from wickable material, such as, for example, polyester mesh, hydrophobic material, such as for example, polyester mesh, or absorbent material, such as, for example, nylon mesh. Further, fabric 300 could be loaded with moisture management technology, such as, for example, absorbent particles 314 or moisture wicking channels 316.

While the invention has been particularly shown and described with reference to a preferred embodiment thereof, it will be understood by those skilled in the art that various other changes in the form and details may be made without departing from the spirit and scope of the invention.

I claim:

1. A shoe comprising an upper, the upper comprising:

an upper sole junction and a throat;

a three dimensional fabric including a sole attachment side, a throat side, a back facing side, a body, and a top facing side;

the body of the three dimensional fabric including a plurality of channels formed between the back facing side and the top facing side in at least a portion of the body of the three dimensional fabric;

at least one loop, the at least one loop including a bottom section towards the upper sole junction and a top section opposite the bottom section towards the throat;

at least a portion of the at least one loop residing in at least one of the plurality of channels; and at least one lace operatively associated with the at least one loop proximate the top section of the at least one loop, wherein the at least one loop distributes a tightening force across at least a portion of the upper when tightening the at least one lace.

2. The upper of claim 1, wherein the three dimensional fabric comprises a mesh.

3. The upper of claim 1, wherein the top facing side and the body have different densities.

4. The upper of claim 1, wherein the back facing side and the body have different densities.

5. The upper of claim 1, wherein the top facing side and the back facing side have different densities.

6. The upper of claim 1, further comprising a plurality of moisture management particles suspended in the body.

7. The upper of claim 6, wherein the moisture management particles comprise a particle selected from the group consisting of absorbent material or hydrophobic material.

8. The upper of claim 1, further comprising a moisture management channel in the three dimensional fabric.

9. The upper of claim 1, further comprising a layer of moisture management fabric coupled to the three dimensional fabric.

10. The upper of claim 9, wherein the moisture management fabric is selected from a group of fabrics consisting of absorbent fabric, hydrophobic fabric, or wickable fabric.

11. The upper of claim 1, wherein the bottom section is coupled to the shoe at the upper sole junction.

12. A garment comprising:

a gap with opposing edges to be tightened by at least one lace;

a three dimensional fabric including a body facing side, a body, a top side, and a plurality of channels formed between the back facing side and the top facing side in at least a portion of the body of the three dimensional fabric;

at least one loop, the at least one loop including at least one top section arranged about the gap and at least partially contained within at least one of the plurality of channels; and the at least one lace operatively associated with the at least one loop such that tightening the at least one lace distributes a tightening force about the three dimensional fabric.

13. The garment according to claim 12, wherein the at least one loop has at least two top sections arranged on opposing sides of the gap such that tightening force is distributed about the entire garment from one side of the gap to another side of the gap.

14. The garment according to claim 12 where the at least one loop forms a plurality of top sections on each side of the gap.

15. The garment according to claim 12, wherein the garment is selected from a group of garments consisting of a jacket, a shirt, a short, a pant, a glove, a shoe, and a hat.

16. A shoe having an upper, the upper connected to the sole at an upper sole junction, the upper comprising:

a fabric, the fabric extending from a throat to the upper sole junction;

the fabric formed with voids forming at least one channel extending from the throat to the upper sole junction;

means for distributing a tightening force contained in the at least one channel, the means for distributing a tightening force distributes a tightening force about a foot received within the shoe; and at least one lace laced about the throat and attached to the means for distributing a tightening force, such that tightening the at least one lace about the throat supplies the tightening force distributed by the means for distributing a tightening force.

17. The shoe of claim 16, wherein the means for distributing comprises a loop.

18. The shoe of claim 17, wherein the loop extends from the throat to the upper sole junction.

* * * * *